United States Patent [19]

Rudnick

[11] Patent Number: 4,784,744

[45] Date of Patent: Nov. 15, 1988

[54] PROCESS FOR STABILIZING INTERMEDIATES AND IMPROVING LIQUID YIELDS AND COKE QUALITY

[75] Inventor: Leslie R. Rudnick, Lawrenceville, N.J.

[73] Assignee: Mobil Oil Corporation, New York, N.Y.

[21] Appl. No.: 94,974

[22] Filed: Sep. 10, 1987

[51] Int. Cl.[4] ..... C10G 9/16; C10G 9/12

[52] U.S. Cl. ..... 208/48 AA; 585/942

[58] Field of Search ..... 208/48 AA; 585/942

[56] References Cited

U.S. PATENT DOCUMENTS

| | | | |
|---|---|---|---|
| 4,002,554 | 1/1977 | Borge et al. | 208/48 AA |
| 4,298,455 | 11/1981 | Huang | 208/48 AA |
| 4,670,131 | 6/1987 | Ferrell | 208/48 AA |

OTHER PUBLICATIONS

Driscoll et al., J. Am. Chem. Soc., vol. 107(1), pp. 57–63 (1985).

*Primary Examiner*—Asok Pal

*Attorney, Agent, or Firm*—Alexander J. McKillop; Michael G. Gilman; Van D. Harrison, Jr.

[57] ABSTRACT

Disclosed herein is a process for stabilizing the liquid resulting from the thermal treatment of a hydrocarbon resid by coking, visbreaking or thermal cracking. The liquid product is contacted with a gaseous stream of hydrocarbons from an exterior source containing alkyl such as methyl $CH_3$. free-radicals. The free radicals are derived by contacting methane, ethane, propane or a mixture thereof with a magnesia catalyst at a temperature of about 500° C.

16 Claims, No Drawings

PROCESS FOR STABILIZING INTERMEDIATES AND IMPROVING LIQUID YIELDS AND COKE QUALITY

NATURE OF THE INVENTION

This invention relates to a process for upgrading the liquid product obtained from thermally treating heavy liquid hydrocarbon feedstocks. More particularly this invention is directed to a process in which the free-radical intermediates formed during a coking operation are trapped and stabilized by reacting them with externally generated alkyl free-radicals.

BACKGROUND OF THE INVENTION

During various refining operations, petroleum feedstocks are often thermally treated by cracking, coking or visbreaking operations at elevated temperatures in order to produce additional liquid product. A side effect from using these high temperatures is, however, the formation of coke. This undesirable not only because it reduces the the yield of liquid products, but also because is has other unfavorable effects upon the process. In visbreaking and thermal cracking a certain amount of coke production has generally been regarded as an unavoidable result but even here the principal objective has been to maximize the yield of high value liquid products and to minimize the coke made, especially the lower value shot coke. There is, therefore, a continuing need to reduce the coking tendencies of petroleum feedstocks.

Although the use of hydrogen donors may be effective in removing contaminates without causing a significant degree of coking as described in U.S. Pat. No. 3,839,187, it is desirable, nevertheless to avoid the use of hydrogen or hydrogen donors and to rely instead upon a simple non-hydrogenative process. More recently, as in U.S. Pat. No. 4,298,455, it has been proposed to minimize the amount of coke or tar and gas formed during a conventional visbreaking process by conducting the process in the presence of a chain transfer agent and a free radical initiator. The free radical initiator reacts with the chain transfer agent to create a free radical which competes with the larger chain hydrocarbons to prevent the formation of tar or coke. Unsaturated hydrocarbons react with the free radical to form saturated hydrocarbons which cannot be polymerized further. This process, of course, requires both the presence of a free-radical initiator and a chain transfer agent.

A primary object of this invention is to provide a process for stabilizing products derived by thermal cracking. Another object of this invention is to achieve such stabilization without the use of chain transfer agents and free radical initiators.

SUMMARY OF THE INVENTION

Briefly stated this invention comprises thermally treating a heavy liquid hydrocarbon, such as a liquid petroleum resid by thermal cracking, visbreaking, or coking and contacting the freshly treated liquid product with alkyl free-radicals supplied from an external alkyl free-radical source.

DETAILED DESCRIPTION OF THE INVENTION

As indicated above, the process of this invention is one in which free-radical intermediates formed in a liquid hydrocarbon feedstock such as a heavy petroleum resid during coking, visbreaking, or thermal cracking are trapped and stabilized by externally generated alkyl free radicals obtained from methane, ethane, propane, butane, ethylene, propylene, butylene and mixtures of these. More generally the free-radicals can be those obtained from a hydrocarbon stream containing alkanes, alkenes, alkynes and mixtures thereof. The alkyl radicals which normally are available diluted in a hydrocarbon stream are generated from the hydrocarbon stream by known techniques, for example, methyl radicals from methane by a process such as that described in the publication, "Formation of Gas-Phase Methyl Radicals over MgO" by Daniel J. Driscoll, et al., at pages 58–63, of volume 107 of the Journal of the American Chemical Society, 1985. which is incorporated herein by reference. This publication describes a process whereby methane is converted into methyl radicals by passing methane and nitrous oxide over a magnesia (MgO) catalyst at a temperature of around 500° C. to generate methyl radicals. The resulting gaseous stream containing the alkyl free-radicals (methyl radicals) is then contacted with the freshly thermally treated liquid hydrocarbon. The alkyl radicals from the exterior source react with the heavier hydrocarbon free-radicals present in the thermally treated material resulting in a non-reactive or stabilized liquid hydrocarbon.

The process described herein differs from H-donor processes in that alkyl radicals are used in this process rather than the hydrogen from hydrogen-donors.

I claim:

1. A process for reducing the amount of coke in a liquid hydrocarbon product from a thermal treating process comprising mixing with said liquid hydrocarbon a hydrocarbon stream from an extraneous source containing methyl free-radicals.

2. The process of claim 1 in which the thermal treating process is a visbreaking process.

3. The process of claim 1 wherein the thermal treating process is a coking process.

4. The process of claim 1 wherein the thermal treating process is a thermal craking process.

5. The process of claim 1 wherein the hydrocarbon stream is a mixture of hydrocarbons selected from the group consisting of alkanes, alkenes, alkynes and mixtures thereof.

6. The process of claim 1 wherein the alkyl radical is obtained from a hydrocarbon selected from the group consisting of methane, ethane, propane, butane, ethylene, propylene, butylene, and mixtures of two or more of these.

7. The process of claim 1 wherein the methyl radicals are produced by the catalytic effect of magnesia on methane.

8. A process for reducing the amount of coke in a liquid hydrocarbon product from a thermal treating process comprising contacting said liquid hydrocarbon with a hydrocarbon stream from an extraneous source containing methyl free-radicals derived from passing methane gas over magnesia at a temperature of about 500° C.

9. A process for reducing the viscosity of a liquid hydrocarbon product from a thermal treating process comprising mixing with said liquid hydrocarbon a hydrocarbon stream from an extraneous source containing methyl free-radicals.

10. The process of claim 9 in which the thermal treating process is a visbreaking process.

11. The process of claim 9 wherein the thermal treating process is a coking process.

12. The process of claim 9 wherein the thermal treating process is a thermal cracking process.

13. The process of claim 9 wherein the hydrocarbons stream is a mixture of hydrocarbons selected from the group consisting of alkanes, alkenes, alkynes and mixtures thereof.

14. The process of claim 9 wherein the alkyl radical is obtained from a hydrocarbon selected from the group consisting of methane, ethane, propane, butane, ethylene, propylene, butylene and mixtures of two or more of these.

15. The process of claim 9 wherein the methyl radicals are produced by a catalytic effect of magnesia on methane.

16. A process for reducing the viscosity of in a liquid hydrocarbon product from a thermal treating process comprising contacting said liquid hydrocarbon with a hydrocarbon stream from an extraneous source containing methyl free-radicals derived from passing methane gas over magnesia at a temperature of about 500° C.

* * * * *